US007767599B2

(12) United States Patent
Prickett

(10) Patent No.: US 7,767,599 B2
(45) **Date of Patent: *Aug. 3, 2010**

(54) MULTIDENIER FIBER CUT RESISTANT FABRICS AND ARTICLES

(75) Inventor: Larry John Prickett, Chesterfield, VA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 841 days.

This patent is subject to a terminal disclaimer.

(21) Appl. No.: 11/545,736

(22) Filed: Oct. 10, 2006

(65) Prior Publication Data

US 2008/0085646 A1 Apr. 10, 2008

(51) Int. Cl.
*B32B 27/04* (2006.01)

(52) U.S. Cl. ..... 442/135

(58) Field of Classification Search ..... None
See application file for complete search history.

(56) References Cited

U.S. PATENT DOCUMENTS

| | | | | |
|---|---|---|---|---|
| 3,047,455 | A | 7/1962 | Holmes et at | |
| 3,063,966 | A | 11/1962 | Kwolek et al. | |
| 3,767,756 | A | 10/1973 | Blades et al. | |
| 3,869,429 | A | 3/1975 | Blades | |
| 3,869,430 | A | 3/1975 | Blades | |
| 4,457,985 | A | 7/1984 | Harpell et al. | |
| 4,918,912 | A | 4/1990 | Warner | |
| 5,525,700 | A | 6/1996 | Samuels et al. | |
| 6,001,474 | A * | 12/1999 | Prickett et al. | 428/359 |
| 6,829,881 | B1 | 12/2004 | Manten | |
| 2002/0106956 | A1 | 8/2002 | Howland | |
| 2003/0129595 | A1 | 7/2003 | Zhu | |
| 2004/0025481 | A1 | 2/2004 | Takiue | |
| 2004/0235383 | A1 | 11/2004 | Perry et al. | |
| 2005/0204718 | A1 | 9/2005 | Zhu et al. | |

FOREIGN PATENT DOCUMENTS

| | | |
|---|---|---|
| EP | 0 237 451 | 9/1987 |

* cited by examiner

*Primary Examiner*—Arti Singh-Pandey

(57) ABSTRACT

This invention relates to cut resistant fabrics and articles including gloves, and processes for making cut resistant articles, the fabrics and articles comprising a yarn comprising an intimate blend of staple fibers, the blend comprising 20 to 50 parts by weight of a lubricating fiber; 20 to 40 parts by weight of a first aramid fiber having a linear density of from 3.3 to 6 denier per filament (3.7 to 6.7 dtex per filament); and 20 to 40 parts by weight of a second aramid fiber having a linear density of from 0.50 to 4.5 denier per filament (0.56 to 5.0 dtex per filament); based on the total weight of the lubricating and first and second aramid fibers. The difference in filament linear density of the first aramid fiber to the second aramid fiber is 1 denier per filament (1.1 dtex per filament) or greater.

16 Claims, 3 Drawing Sheets

MULTIDENIER FIBER CUT RESISTANT FABRICS AND ARTICLES

BACKGROUND OF THE INVENTION

1. Field of the Invention

This invention relates to cut resistant fabrics and articles including gloves and methods of making the same.

2. Description of Related Art

United States Patent Application Publication US 2004/0235383 to Perry et al. discloses a yarn or fabric useful in protective garments designed for activities where exposure to molten substance splash, radiant heat, or flame is likely to occur. The yarn or fabric is made of flame resistant fibers and micro-denier flame resistant fibers. The weight ratio of the flame resistant fibers to the micro-denier flame resistant fibers is in the range of 4-9:2-6.

United States Patent Application Publication US 2002/0106956 to Howland discloses fabrics formed from intimate blends of high-tenacity fibers and low-tenacity fibers wherein the low-tenacity fibers have a denier per filament substantially below that of the high tenacity fibers.

United States Patent Application Publication US 2004/0025486 to Takiue discloses a reinforcing composite yarn comprising a plurality of continuous filaments and paralleled with at least one substantially non-twisted staple fiber yarn comprising a plurality of staple fibers. The staple fibers are preferably selected from nylon 6 staple fibers, nylon 66 staple fibers, meta-aromatic polyamide staple fibers, and para-aromatic polyamide staple fibers.

Articles made from para-aramid fibers have excellent cut performance and command a premium price in the marketplace. Such articles, however, can be stiffer than articles made with traditional textile fibers and in some applications the para-aramid articles can abrade more quickly than desired. Therefore, any improvement in either the comfort, durability or the amount of aramid material needed for adequate cut performance in articles is desired.

BRIEF SUMMARY OF THE INVENTION

The present invention relates to a cut resistant fabric, comprising a yarn comprising an intimate blend of staple fibers, the blend comprising:

a) 20 to 50 parts by weight of a lubricating fiber;

b) 20 to 40 parts by weight of a first aramid fiber having a linear density of from 3.3 to 6 denier per filament (3.7 to 6.7 dtex per filament); and c) 20 to 40 parts by weight of a second aramid fiber having a linear density of from 0.50 to 4.5 denier per filament (0.56 to 5.0 dtex per filament), based on 100 parts by weight of the fibers of a), b) and c);

wherein the difference in filament linear density of the first aramid fiber to the second aramid fiber is 1 denier per filament (1.1 dtex per filament) or greater.

The present invention further relates to a process for making a cut resistant article comprising:

a) blending i) 20 to 50 parts by weight of a lubricating staple fiber;

ii) 20 to 40 parts by weight of a first aramid staple fiber having a linear density of from 3.7 to 6.7 dtex per filament; and iii) 20 to 40 parts by weight of a second aramid staple fiber having a linear density of from 0.56 to 5.0 dtex per filament, based on 100 parts by weight of the fibers of i), ii) and iii), wherein the difference in filament linear density of the first aramid fiber to the second aramid fiber is 1.1 dtex per filament or greater;

b) forming a spun staple yarn from the blend of fibers; and c) knitting an article from the spun staple yarn.

DETAILED DESCRIPTION OF THE INVENTION

Figure 1:
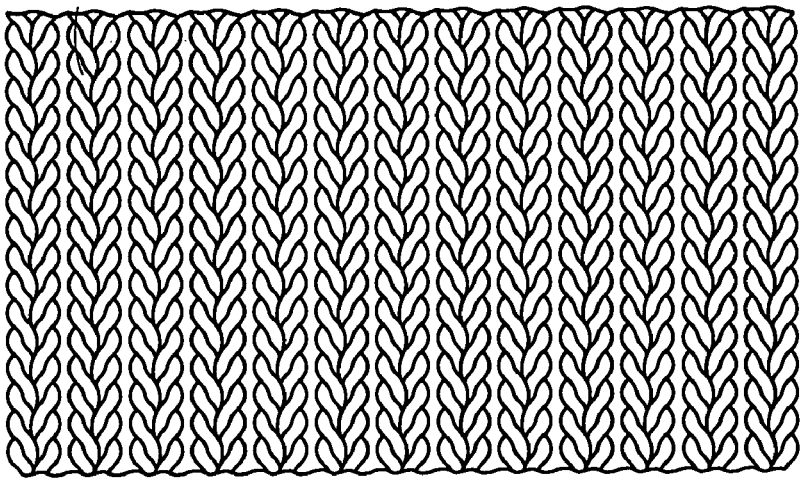
FIG. 1 is a representation of one possible knitted fabric of this invention.

In one embodiment, this invention relates to cut resistant fabric comprising a yarn comprising an intimate blend of staple fibers, the blend comprising 20 to 50 parts by weight of a lubricating fiber; 20 to 40 parts by weight of a first aramid fiber having a linear density of from 3.3 to 6 denier per filament (3.7 to 6.7 dtex per filament); and 20 to 40 parts by weight of a second aramid fiber having a linear density of from 0.50 to 4.5 denier per filament (0.56 to 5.0 dtex per filament); based on the total weight of the lubricating fibers and first and second aramid fibers. In some preferred embodiments the first aramid fiber has a linear density of from 3.3 to 5.0 denier per filament (3.7 to 5.6 dtex per filament) and in some preferred embodiments the second aramid fiber has a linear density of from 1.0 to 4.0 denier per filament (1.1 to 4.4 dtex per filament). The difference in filament linear density of the first aramid fiber to the second aramid fiber is 1 denier per filament (1.1 dtex per filament) or greater. In some preferred embodiments, the lubricating fiber and the first and second aramid fibers are each present individually in amounts ranging from about 26 to 40 parts by weight, based on 100 parts by weight of these fibers. In some most preferred embodiments, the three types of fibers are present in substantially equal parts by weight.

Surprisingly, it has been found that fabrics of this invention have cut resistance equivalent to or greater than a fabric made with commonly used 100% 1.5 denier-per-filament (1.7 dtex per filament) para-aramid fiber yarns. In other words, the cut resistance of a 100% para-aramid fiber fabric can be duplicated by a fabric having at most 80 parts by weight para-aramid fiber. It is believed the three types of fibers, namely the lubricating fiber, higher denier-per-filament aramid fiber, and lower denier-per-filament aramid fiber, work together to provide not only cut resistance but also improved fabric abrasion resistance and flexibility, which translates to improved durability and comfort in use.

The word "fabric" is meant to include any woven, knitted, or non-woven layer structure or the like that utilizes yarns. By "yarn" is meant an assemblage of fibers spun or twisted together to form a continuous strand. As used herein, a yarn generally refers to what is known in the art as a singles yarn, which is the simplest strand of textile material suitable for such operations as weaving and knitting. A spun staple yarn can be formed from staple fibers with more or less twist; a continuous multifilament yarn can be formed with or without twist. When twist is present, it is all in the same direction. As used herein the phrases "ply yarn" and "plied yarn" can be used interchangeably and refer to two or more yarns, i.e. singles yarns, twisted or plied together. "Woven" is meant to include any fabric made by weaving; that is, interlacing or interweaving at least two yarns typically at right angles. Generally such fabrics are made by interlacing one set of yarns, called warp yarns, with another set of yarns, called weft or fill yarns. The woven fabric can have essentially any weave, such as, plain weave, crowfoot weave, basket weave, satin weave, twill weave, unbalanced weaves, and the like. Plain weave is the most common. "Knitted" is meant to include a structure producible by interlocking a series of loops of one or more yarns by means of needles or wires, such as warp knits (e.g., tricot, milanese, or raschel) and weft knits (e.g., circular or flat). "Non-woven" is meant to include a network of fibers forming a flexible sheet material producible without weaving or knitting and held together by either (i) mechanical interlocking of at least some of the fibers, (ii) fusing at least some parts of some of the fibers, or (iii) bonding at least some of the fibers by use of a binder material. Non-woven fabrics that utilize yarns include primarily unidirectional fabrics, however other structures are possible.

In some preferred embodiments, the fabric of this invention is a knitted fabric, using any appropriate knit pattern and conventional knitting machines. FIG. 1 is a representation of a knitted fabric. Cut resistance and comfort are affected by tightness of the knit and that tightness can be adjusted to meet any specific need. A very effective combination of cut resistance and comfort has been found in, for example, single jersey knit and terry knit patterns. In some embodiments, fabrics of this invention have a basis weight in the range of 3 to 30 oz/yd$^2$ (100 to 1000 g/m$^2$), preferably 5 to 25 oz/yd$^2$ (170 to 850 g/m$^2$), the fabrics at the high end of the basis weight range providing more cut protection.

Figure 2:
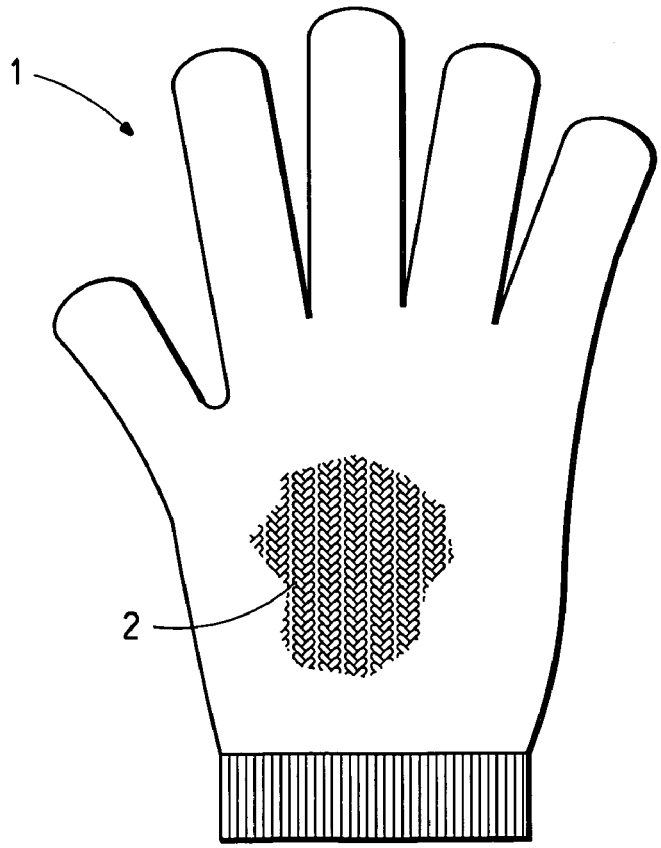
FIG. 2 is one article of this invention in the form of a knitted glove.

The fabrics of this invention can be utilized in articles to provide cut protection. Useful articles include but are not limited to gloves, aprons, and sleeves. In one preferred embodiment the article is a cut resistant glove that is knitted. FIG. 2 is a representation of one such glove 1 having a detail 2 illustrating the knitted construction of the glove.

Figure 3:
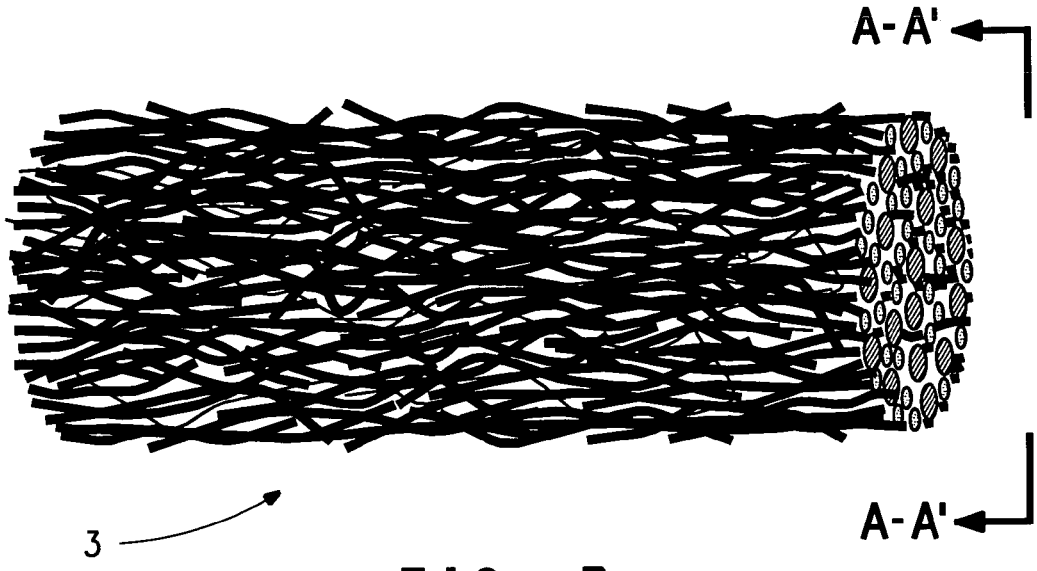
FIG. 3 is a representation of a section of staple fiber yarn comprising one possible intimate blend of fibers.

In the fabrics and articles including gloves of this invention, the difference in filament linear density of the higher denier-per-filament aramid fiber and the lower denier-per-filament aramid fiber is 1 denier per filament (1.1 dtex per filament) or greater. In some preferred embodiments, the difference in filament linear density is 1.5 denier per filament (1.7 dtex per filament) or greater. It is believed the lubricating fiber reduces the friction between fibers in the staple yarn bundle, allowing the lower denier-per-filament aramid fiber and the higher denier-per-filament aramid fiber to more easily move in the fabric yarn bundles. FIG. 3 is a representation of a section of staple fiber yarn 3 comprising one possible intimate blend of fibers.

Figure 4:
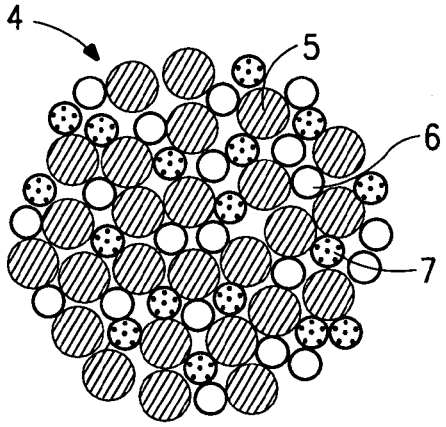
FIG. 4 is an illustration of one possible cross section of a staple yarn bundle useful in the fabrics of this invention.

FIG. 4 is one possible embodiment of a cross-section A-A' of the staple fiber yarn bundle of FIG. 3. The staple fiber yarn 4 contains a first aramid fiber 5 having a linear density of from 3.3 to 6 denier per filament (3.7 to 6.7 dtex per filament), and a second aramid fiber 6 having a linear density of from 0.50 to 4.5 denier per filament (0.56 to 5.0 dtex per filament). Lubricating fiber 7 has a linear density in the same range as the second aramid fiber 6. The lubricating fiber is uniformly distributed in the yarn bundle and in many instances acts as to separate the first and second aramid fibers. It is thought this helps avoid substantial interlocking of any aramid fibrils (not shown) that can be present or generated from wear on the surface of aramid fibers and also provides a lubricating effect on the filaments in the yarn bundle, providing fabrics made from such yarns with a more textile fiber character and better aesthetic feel or "hand".

Figure 5:
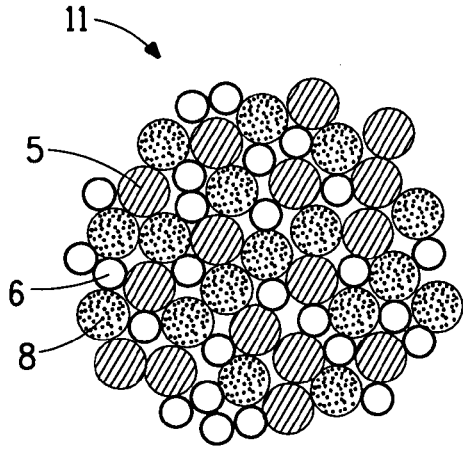
FIG. 5 is an illustration of another possible cross section of a staple yarn bundle useful in the fabrics of this invention.
Figure 6:
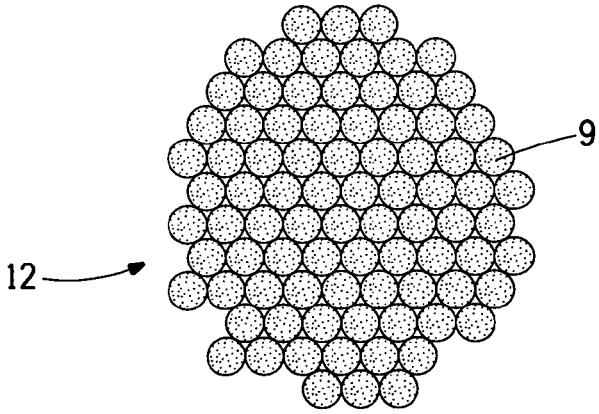
FIG. 6 is an illustration of the cross section of a prior art staple yarn bundle having commonly used 1.5 denier per filament (1.7 dtex per filament) para-aramid fiber.

FIG. 5 illustrates another possible embodiment of a cross-section A-A' of the staple fiber yarn bundle of FIG. 3. Yarn bundle 11 has the same first and second aramid fibers 5 and 6 as FIG. 4 however the lubricating fiber 8 has a linear density of in the same range as the first aramid fiber 5. In comparison, FIG. 6 is an illustration of a cross-section of the yarn bundle of a prior art commonly used 1.5 denier per filament (1.7 dtex per filament) para-aramid staple yarn 12 with 1.5 denier per filament (1.7 dtex per filament) fibers 9. For simplicity in the figures, in those instances where the lubricating fiber is said to be roughly the same denier as an aramid fiber type, it is shown having the same diameter as that aramid fiber type. The actual fiber diameters may be slightly different due to differences in the polymer densities. While in all of these figures the individual fibers are represented as having a round cross section, and that many of the fibers useful in these bundles preferably can have a round, oval or bean cross-sectional shape, it is understood that fibers having other cross sections can be used in these bundles.

Figure 7:
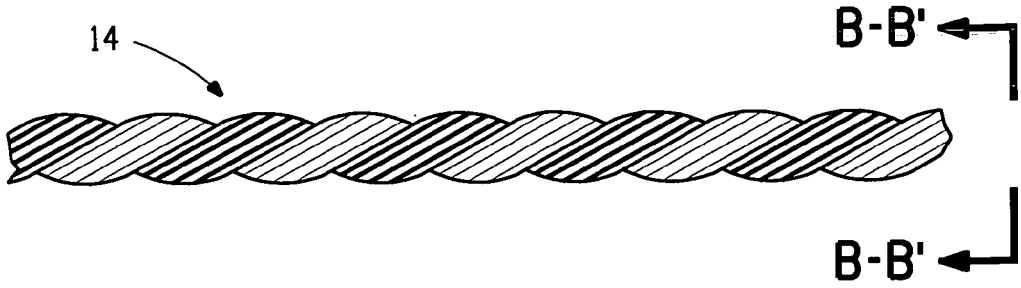
FIG. 7 is an illustration of a one possible ply yarn made from two singles yarns.
Figure 8:
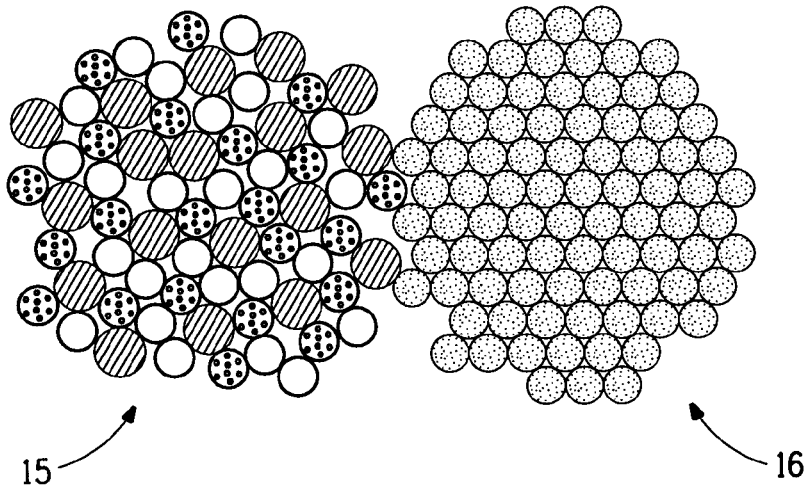
FIG. 8 is an illustration of one possible cross section of a ply yarn made from two different singles yarns.
Figure 9:
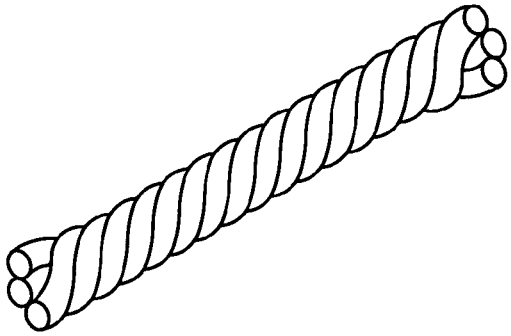
FIG. 9 is an illustration of one possible ply yarn made from three singles yarns.

While in the figures these bundles of fibers represent singles yarns, it is understood these multidenier singles yarns can be plied with one or more other singles yarns to make plied yarns. For example, FIG. 7 is an illustration of one embodiment of a ply- or plied-yarn 14 made from ply-twisting two singles yarns together. FIG. 8 is one possible embodiment of a cross-section B-B' of the ply yarn bundle of FIG. 7 containing two singles yarns, with one singles yarn 15 made from an intimate blend of multidenier staple fibers as described previously and one singles yarn 16 made from only one type of filaments. While two different singles are shown in these figures, this is not restrictive and it should be understood the ply yarn could contain more than two yarns ply-twisted together. For example, FIG. 9 is an illustration of three singles yarns ply-twisted together. It should also be understood the ply yarn can be made from two or more singles yarns made from an intimate blend of multidenier staple fibers as described previously, or the ply yarn can be made from at least one of the singles yarn made from an intimate blend of multidenier staple fibers and at least one yarn having any desired composition, including for example a yarn comprising continuous filament.

Surprisingly, the fabric of this invention has improved flexibility over the fabric made with commonly used 1.5 denier per filament (1.7 dtex per filament) fibers, despite the fact the intimate blend utilizes a large number of filaments that have a larger diameter than the diameter of the 1.5 denier per filament (1.7 dtex per filament) fibers.

The cut resistant fabrics and gloves of this invention comprise a yarn comprising an intimate blend of staple fibers. By intimate blend it is meant the various staple fibers are distributed homogeneously in the staple yarn bundle. The staple fibers used in some embodiments of this invention have a length of 2 to 20 centimeters. The staple fibers can be spun into yarns using short-staple or cotton-based yarn systems, long-staple or woolen-based yarn systems, or stretch-broken yarn systems. In some embodiments the staple fiber cut length is preferably 3.5 to 6 centimeters, especially for staple to be used in cotton based spinning systems. In some other embodiments the staple fiber cut length is preferably 3.5 to 16 centimeters, especially for staple to be used in long staple or woolen based spinning systems. The staple fibers used in many embodiments of this invention have a diameter of 5 to 30 micrometers and a linear density in the range of about 0.5 to 6.5 denier per filament (0.56 to 7.2 dtex per filament), preferably in the range of 1.0 to 5.0 denier per filament (1.1 to 5.6 dtex per filament).

"Lubricating fiber" as used herein is meant to include any fiber that, when used with the multidenier aramid fiber in the proportions designated herein to make a yarn, increases the flexibility of fabrics or articles (including gloves) made from that yarn. It is believed that the desired effect provided by the lubricating fiber is associated with the non-fibrillating and yarn-to-yarn frictional properties of the fiber polymer. Therefore, in some preferred embodiments the lubricating fiber is a non-fibrillating or "fibril-free" fiber. In some embodiments the lubricating fiber has a yarn-on-yarn dynamic friction coefficient, when measured on itself, of less than 0.55, and in some embodiments the dynamic friction coefficient is less than 0.40, as measured by the ASTM Method D3412 capstan method at 50 grams load, 170 degree wrap angle, and 30 cm/second relative movement. For example, when measured in this manner, polyester-on-polyester fiber has a measured dynamic friction coefficient of 0.50 and nylon-on-nylon fiber has a measured dynamic friction coefficient of 0.36. It is not necessary that the lubricant fiber have any special surface finish or chemical treatment to provide the lubricating behavior. Depending on the desire aesthetics of the final fabric and article, the lubricating fiber can have a filament linear density equal to filament linear density of one of the aramid fiber types in the yarn or can have a filament linear density different from the filament linear densities of the aramid fibers in the yarn.

In some preferred embodiments of this invention, the lubricating fiber is selected from the group of aliphatic polyamide fiber, polyolefin fiber, polyester fiber, acrylic fiber and mixtures thereof. In some embodiments the lubricating fiber is a thermoplastic fiber. "Thermoplastic" is meant to have its traditional polymer definition; that is, these materials flow in the manner of a viscous liquid when heated and solidify when cooled and do so reversibly time and time again on subsequent heatings and coolings. In some most preferred embodiments the lubricating fiber is a melt-spun or gel-spun thermoplastic fiber.

In some preferred embodiments aliphatic polyamide fiber refers to any type of fiber containing nylon polymer or copolymer. Nylons are long chain synthetic polyamides having recurring amide groups (—NH—CO—) as an integral part of the polymer chain, and two common examples of nylons are nylon 66, which is polyhexamethylenediamine adipamide, and nylon 6, which polycaprolactam. Other nylons can include nylon 11, which is made from 11-aminoundecanoic acid; and nylon 610, which is made from the condensation product of hexamethylenediamine and sebacic acid.

In some embodiments, polyolefin fiber refers to a fiber produced from polypropylene or polyethylene. Polypropylene is made from polymers or copolymers of propylene. One polypropylene fiber is commercially available under the trade name of Marvess® from Phillips Fibers. Polyethylene is made from polymers or copolymers of ethylene with at least 50 mole percent ethylene on the basis of 100 mole percent polymer and can be spun from a melt; however in some preferred embodiments the fibers are spun from a gel. Useful polyethylene fibers can be made from either high molecular weight polyethylene or ultra-high molecular weight polyethylene. High molecular weight polyethylene generally has a weight average molecular weight of greater than about 40,000. One high molecular weight melt-spun polyethylene fiber is commercially available from Fibervisions®; polyolefin fiber can also include a bicomponent fiber having various polyethylene and/or polypropylene sheath-core or side-by-side constructions. Commercially available ultra-high molecular weight polyethylene generally has a weight average molecular weight of about one million or greater. One ultra-high molecular weight polyethylene or extended chain polyethylene fiber can be generally prepared as discussed in U.S. Pat. No. 4,457,985. This type of gel-spun fiber is commercially available under the trade names of Dyneema® available from Toyobo and Spectra® available from Honeywell.

In some embodiments, polyester fiber refers to any type of synthetic polymer or copolymer composed of at least 85% by weight of an ester of dihydric alcohol and terephthalic acid. The polymer can be produced by the reaction of ethylene glycol and terephthalic acid or its derivatives. In some embodiments the preferred polyester is polyethylene terephthalate (PET). Polyester formulations may include a variety of comonomers, including diethylene glycol, cyclohexanedimethanol, poly(ethylene glycol), glutaric acid, azelaic acid, sebacic acid, isophthalic acid, and the like. In addition to these comonomers, branching agents like trimesic acid, pyromellitic acid, trimethylolpropane and trimethyloloethane, and pentaerythritol may be used. PET may be obtained by known polymerization techniques from either terephthalic acid or its lower alkyl esters (e.g. dimethyl terephthalate) and ethylene glycol or blends or mixtures of these. Useful polyesters can also include polyethylene napthalate (PEN). PEN may be obtained by known polymerization techniques from 2,6 napthalene dicarboxylic acid and ethylene glycol.

In some other embodiments the preferred polyesters are aromatic polyesters that exhibit thermotropic melt behavior. These include liquid crystalline or anisotropic melt polyesters such as available under the tradename of Vectran® available from Celanese. In some other embodiments fully aromatic melt processable liquid crystalline polyester polymers having low melting points are preferred, such as those described in U.S. Pat. No. 5,525,700.

In some embodiments, acrylic fiber refers to a fiber having at least 85 weight percent acrylonitrile units, an acrylonitrile unit being —(CH2-CHCN)—. The acrylic fiber can be made from acrylic polymers having 85 percent by weight or more of acrylonitrile with 15 percent by weight or less of an ethylenic monomer copolymerizable with acrylonitrile and mixtures of two or more of these acrylic polymers. Examples of the ethylenic monomer copolymerizable with acylonitrile include acylic acid, methacrylic acid and esters thereof (methyl acrylate, ethyl acrylate, methyl methacylate, ethyl methacrylate, etc.), vinyl acetate, vinyl chloride, vinylidene chloride, acrylamide, methacylamide, methacrylonitrile, allylsulfonic acid, methanesulfonic acid and styrenesulfonic acid. Acrylic fibers of various types are commercially available from Sterling Fibers, and one illustrative method of making acrylic polymers and fibers is disclosed in U.S. Pat. No. 3,047,455.

In some embodiments of this invention, the lubricating staple fibers have a cut index of at least 0.8 and preferably a cut index of 1.2 or greater. In some embodiments the preferred lubricating staple fibers have a cut index of 1.5 or greater. The cut index is the cut performance of a 475 grams/square meter (14 ounces/square yard) fabric woven or knitted from 100% of the fiber to be tested that is then measured by ASTM F1790-97 (measured in grams, also known as the Cut Protection Performance (CPP)) divided by the areal density (in grams per square meter) of the fabric being cut.

In some embodiments of this invention, the preferred aramid staple fibers are para-aramid fibers. By para-aramid fibers is meant fibers made from para-aramid polymers; poly (p-phenylene terephthalamide) (PPD-T) is the preferred para-aramid polymer. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which do not adversely affect the properties of the para-aramid.

Additives can be used with the para-aramid in the fibers and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

Para-aramid fibers are generally spun by extrusion of a solution of the para-aramid through a capillary into a coagulating bath. In the case of poly(p-phenylene terephthalamide), the solvent for the solution is generally concentrated sulfuric acid and the extrusion is generally through an air gap into a cold, aqueous, coagulating bath. Such processes are well known and are generally disclosed in U.S. Pat. Nos. 3,063,966; 3,767,756; 3,869,429, & 3,869,430. P-aramid fibers are available commercially as Kevlar® brand fibers, which are available from E. I. du Pont de Nemours and Company, and Twaron® brand fibers, which are available from Teijin, Ltd.

This invention also relates to processes for making a cut resistant article, such as a fabric or glove, comprising the steps of blending 20 to 50 parts by weight of a lubricating staple fiber, 20 to 40 parts by weight of a first aramid staple fiber having a linear density of from 3.3 to 6 denier per filament (3.7 to 6.7 dtex per filament), and 20 to 40 parts by weight of a second aramid staple fiber having a linear density of from 0.50 to 4.5 denier per filament (0.56 to 5.0 dtex per filament), based on the total weight of the lubricating and first and second aramid fibers, and wherein the difference in filament linear density of the first aramid fiber to the second aramid fiber is 1 denier per filament (1.1 dtex per filament) or greater; forming a spun staple yarn from the blend of fibers; and knitting the article from the spun staple yarn. In some preferred embodiments, the lubricating fiber and the first and second aramid fibers are present in an amount that is 26 to 40 parts by weight, based on 100 parts by weight of these fibers. In some most preferred embodiments, the three types of fibers are present in substantially equal parts by weight.

In some preferred embodiments, the intimate staple fiber blend is made by first mixing together staple fibers obtained from opened bales, along with any other staple fibers, if desired for additional functionality. The fiber blend is then formed into a sliver using a carding machine. A carding machine is commonly used in the fiber industry to separate, align, and deliver fibers into a continuous strand of loosely assembled fibers without substantial twist, commonly known as carded sliver. The carded sliver is processed into drawn sliver, typically by, but not limited to, a two-step drawing process.

Spun staple yarns are then formed from the drawn sliver using conventional techniques. These techniques include conventional cotton system, short-staple spinning processes, such as, for example, open-end spinning, ring-spinning, or higher speed air spinning techniques such as Murata air-jet spinning where air is used to twist the staple fibers into a yarn. The formation of spun yarns useful in the fabrics of this invention can also be achieved by use of conventional woolen system, long-staple or stretch-break spinning processes, such as, for example, worsted or semi-worsted ring-spinning. Regardless of the processing system, ring-spinning is the generally preferred method for making cut-resistant staple yarns.

Staple fiber blending prior to carding is one preferred method for making well-mixed, homogeneous, intimate-blended spun yarns used in this invention, however other processes are possible. For example, the intimate fiber blend can be made by cutter blending processes; that is, the various fibers in tow or continuous filament form can be mixed together during or prior to crimping or staple cutting. This method can be useful when aramid staple fiber is obtained from a multidenier spun tow or a continuous multidenier multifilament yarn. For example, a continuous multifilament aramid yarn can be spun from solution through a specially-prepared spinneret to create a yarn wherein the individual aramid filaments have two or more different linear densities; the yarn can then be cut into staple to make a multidenier aramid staple blend. A lubricant fiber can be combined with this multidenier aramid blend either by combining the lubricant fiber with the aramid fiber and cutting them together, or by mixing lubricant staple fiber with the aramid staple fiber after cutting. Another method to blend the fibers is by card and/or drawn sliver-blending; that is, to make individual slivers of the various staple fibers in the blend, or combinations of the various staple fibers in the blend, and supplying those individual carded and/or drawn slivers to roving and/or staple yarn spinning devices designed to blend the sliver fibers while spinning the staple yarn. All of these methods are not intended to be limited and other methods of blending staple fibers and making yarns are possible. All of these staple yarns can contain other fibers as long as the desired fabric attributes are not dramatically compromised.

The spun staple yarn of an intimate blend of fibers is then preferably fed to a knitting device to make a knitted glove. Such knitting devices include a range of very fine to standard gauge glove knitting machines, such as the Sheima Seiki glove knitting machine used in the examples that follow. If desired, multiple ends or yarns can be supplied to the knitting machine; that is, a bundle of yarns or a bundle of plied yarns can be co-fed to the knitting machine and knitted into a glove using conventional techniques. In some embodiments it is desirable to add functionality to the gloves by co-feeding one or more other staple or continuous filament yarns with one or more spun staple yarn having the intimate blend of fibers. The tightness of the knit can be adjusted to meet any specific need. A very effective combination of cut resistance and comfort has been found in for example, single jersey knit and terry knit patterns.

Test Methods

Cut Resistance. Cut resistance data for the following described fabrics was generated using ASTM 1790-04 "Standard Test Method for Measuring Cut Resistance of Materials Used in Protective Clothing. For this test a Tomodynamometer (TDM-100) test machine was used. In performance of the test, a cutting edge, under specified force, is drawn one time across a sample mounted on a mandrel. The cutting edge is a stainless steel knife blade having a sharp edge 70 millimeters long. The blade supply is calibrated by using a load of 500 g on a neoprene calibration material at the beginning and end of the test. A new cutting edge is used for each cut test. The sample is a rectangular piece of fabric; it is cut 50×100 millimeters on the bias at 45 degrees from the warp and fill directions. The mandrel is a rounded electro-conductive bar with a radius of 38 millimeters and the sample along with a narrow copper strip is mounted thereto using double-face tape. The copper strip is sandwiched between the sample and double-face tape. The cutting edge is drawn across the fabric on the mandrel at a right angle with the longitudinal axis of the mandrel. Cut through is recorded when the cutting edge makes electrical contact with the copper strip. At several different forces, the distance drawn from initial contact to cut through is recorded and a graph is constructed of force as a function of distance to cut through. From the graph, the force is determined for cut through at a distance of 0.8 inches or 20 millimeters and is normalized to validate the consistency of the blade supply. The normalized force is reported as the cut resistance force.

EXAMPLES

In the following examples, fabrics were knitted using staple fiber-based ring-spun yarns. The staple fiber blend compositions were prepared by blending various staple fibers of a type shown in the Table 1 in proportions as shown in Table 2. In all cases the aramid fiber was made from poly(paraphenylene terephthalamide) (PPD-T). This type of fiber is known under the trademark of Kevlar® and was manufactured by E. I. du Pont de Nemours and Company. The lubricant fiber component was semi-dull nylon 66 fiber sold by Invista under the designation Type 420.

TABLE 1

| General Fiber Type | Specific Fiber Type | Linear Density denier/filament | Linear Density dtex/filament | Cut Length centimeters |
|---|---|---|---|---|
| Aramid | PPD-T | 1.5 | 1.7 | 4.8 |
| Aramid | PPD-T | 2.25 | 2.5 | 4.8 |
| Aramid | PPD-T | 4.2 | 4.7 | 4.8 |
| Lubricant | nylon | 1.7 | 1.9 | 3.8 |

The yarns used to make the knitted fabrics were made in the following manner. For the control yarn A, approximately seven kilograms of a single type of PPD-T staple fiber was fed directly into a carding machine to make a carded sliver. An equivalent amount (7 to 9 kilograms) of each staple fiber blend composition for yarns 1 through 5 and comparison yarns B through D as shown in Table 2 were then made. The staple fiber blends were made by first hand-mixing the fibers and then feeding the mixture twice through a picker to make uniform fiber blends. Each fiber blend was then fed through a standard carding machine to make carded sliver.

The carded sliver was then drawn using two pass drawing (breaker/finisher drawing) into drawn sliver and processed on a roving frame to make 6560 dtex (0.9 hank count) rovings. Yarns were then produced by ring-spinning two ends of each roving for each composition. 10/1 s cotton count yarns were produced having a 3.10 twist multiplier. Each of the final A through D and 1 through 5 yarns were made by plying a pair of the 10/1 s yarns together with a balancing reverse twist to make 10/2 s yarns.

Each of the 10/2 s yarns were knitted into fabric samples using a standard 7 gauge Sheima Seiki glove knitting machine. The machine knitting time was adjusted to produce glove bodies about one meter long to provide adequate fabric samples for subsequent cut testing. Samples were made by feeding 3 ends of 10/2 s to the glove knitting machine to yield fabric samples having a basis weight of about 20 oz/yd$^2$ (680 g/m$^2$). Standard size gloves were then made having about the same nominal basis weight.

The fabrics were subjected to the aforementioned cut resistance test and the results are shown in Table 2. The table also shows the cut resistance values normalized to an areal density of 20 oz/yd$^2$ (680 g/m$^2$).

The cut resistance of the fabrics and gloves made from yarns 1 through 5 were equivalent to the cut resistance of the fabric and glove made from control yarn A on a normalized weight basis. Although the fabric made from yarn 2 has a lower cut resistance value than that of the fabric made from control yarn A it is noted that the statistical confidential interval for the cut resistance values can account for the conclusion that these have equivalent cut resistance. The fabrics and gloves made from yarns 1 through 5 also had a subjectively more comfortable "hand" than the fabric and glove made from control yarn A.

In addition, comparison fabrics and gloves made from yarns B through D had lower cut resistance than any of the other fabrics or gloves made, which demonstrates how the addition of an aramid fiber having a linear density from 3.3 to 6 denier per filament (3.7 to 6.7 dtex per filament) synergistically acts to increase cut resistance and, in this example, compensate for the lower cut resistance provided by the nylon fiber.

TABLE 2

| Yarn Item Units | 1.5 dpf Aramid Staple Fiber weight % | 2.25 dpf Aramid Staple Fiber weight % | 4.2 dpf Aramid Staple Fiber weight % | Lubricating Nylon Staple Fiber weight % | Areal density oz/yd$^2$ | ASTM 1790-04 Cut Value grams | Normalized Cut Value grams |
|---|---|---|---|---|---|---|---|
| A | 100 | 0 | 0 | 0 | 20.2 | 934 | 926 |
| 1 | 0 | 40 | 40 | 20 | 19.7 | 968 | 983 |
| 2 | 0 | 40 | 20 | 40 | 20.5 | 897 | 875 |
| 3 | 0 | 20 | 40 | 40 | 19.7 | 958 | 973 |
| 4 | 0 | 30 | 30 | 40 | 19.8 | 925 | 934 |
| 5 | 0 | 33.3 | 33.3 | 33.3 | 21.0 | 1032 | 983 |
| B | 0 | 60 | 0 | 40 | 19.8 | 829 | 833 |
| C | 0 | 70 | 0 | 30 | 20.7 | 889 | 859 |
| D | 0 | 80 | 0 | 20 | 21.2 | 913 | 860 |

What is claimed is:

1. A cut resistant fabric, comprising a yarn comprising an intimate blend of staple fibers, the blend comprising:

a) 20 to 50 parts by weight of a lubricating fiber;

b) 20 to 40 parts by weight of a first aramid fiber having a linear density of from 3.3 to 6 denier per filament (3.7 to 6.7 dtex per filament); and c) 20 to 40 parts by weight of a second aramid fiber having a linear density of from 0.50 to 4.5 denier per filament (0.56 to 5.0 dtex per filament), based on 100 parts by weight of the fibers of a), b) and c); wherein the difference in filament linear density of the first aramid fiber to the second aramid fiber is 1 denier per filament (1.1 dtex per filament) or greater.

2. The cut resistant fabric of claim 1, wherein the fibers of a), b) and c) are each present in an amount that is 26 to 40 parts by weight; based on 100 parts by weight of the fibers of a), b) and c).

3. The cut resistant fabric of claim 1, wherein the lubricating fiber is selected from the group consisting of aliphatic polyamide fiber, polyester fiber, polyolefin fiber, acrylic fiber, and mixtures thereof.

4. The cut resistant fabric of claim 1, wherein the first or second aramid fiber comprises poly(paraphenylene terephthalamide).

5. The cut resistant fabric of claim 1, in the form of a knit.

6. An article, comprising the cut resistant fabric of claim 1.

7. The article of claim 6, in the form of a glove.

8. A process for making a cut resistant article, comprising:

a) blending i) 20 to 50 parts by weight of a lubricating staple fiber;

ii) 20 to 40 parts by weight of a first aramid staple fiber having a linear density of from 3.7 to 6.7 dtex per filament; and iii) 20 to 40 parts by weight of a second aramid staple fiber having a linear density of from 0.56 to 5.0 dtex per filament, based on 100 parts by weight of the fibers of i), ii) and iii), wherein the difference in filament linear density of the first aramid fiber to the second aramid fiber is 1.1 dtex per filament or greater;

b) forming a spun staple yarn from the blend of fibers; and c) knitting an article from the spun staple yarn.

9. The process of claim 8, wherein the fibers of i), ii) and iii) are each present in an amount that is 26 to 40 parts by weight; based on 100 parts by weight of the fibers of i), ii) and iii).

10. The process of claim 8, wherein the blending is accomplished at least in part by mixing the fibers of i), ii) and iii) together and carding the fibers to form a sliver containing an intimate staple fiber blend.

11. The process of claim 8, wherein the blending is accomplished immediately preceding or during the forming of a spun staple yarn by providing one or more slivers, each of which contains substantially only one of the fibers of i), ii), and iii), to a staple yarn spinning device.

12. The process of claim 8, wherein the spun staple yarn is formed using ring spinning.

13. The process of claim 8, wherein the lubricating fiber is selected from the group consisting of aliphatic polyamide fiber, polyester fiber, polyolefin fiber, acrylic fiber, and mixtures thereof.

14. The process of claim 8, wherein the first or second aramid fiber comprises poly(paraphenylene terephthalamide).

15. The process of claim 8, wherein the knitting is accomplished by co-feeding to a knitting machine a bundle of yarns or plied yarns comprising the spun staple yarn from the blend of fibers and one or more other staple fiber yarns or continuous filament yarns.

16. The process of claim 8, wherein the article is a fabric or a glove.

* * * * *